United States Patent [19]

Ikeda et al.

[11] Patent Number: 4,764,501

[45] Date of Patent: Aug. 16, 1988

[54] HEAT-SENSITIVE RECORDING MATERIAL

[75] Inventors: Haruhiko Ikeda; Masahiro Higuchi; Shigetoshi Hiraishi, all of Tokyo, Japan

[73] Assignee: Mitsubishi Paper Mills, Ltd., Tokyo, Japan

[21] Appl. No.: 73,288

[22] Filed: Jul. 14, 1987

[30] Foreign Application Priority Data

Jul. 14, 1986 [JP] Japan ..... 61-166498
Oct. 11, 1986 [JP] Japan ..... 61-241790

[51] Int. Cl.[4] ..... B41M 5/18

[52] U.S. Cl. ..... 503/209; 427/150; 427/151; 428/913; 503/208; 503/214; 503/225

[58] Field of Search ..... 427/150–152; 428/913; 503/208, 209, 214, 225

[56] References Cited

U.S. PATENT DOCUMENTS 4,269,893 5/1981 Kato et al. ..... 503/225
4,538,164 8/1985 Takigawa et al. ..... 503/209
4,707,463 11/1987 Ikeda et al. ..... 503/208

FOREIGN PATENT DOCUMENTS 0151394 9/1982 Japan ..... 503/225
0224786 12/1983 Japan ..... 503/208
0214689 12/1984 Japan ..... 503/209

*Primary Examiner*—Bruce H. Hess
*Attorney, Agent, or Firm*—Cushman, Darby & Cushman

[57] ABSTRACT

A heat-sensitive recording material containing a special sensitizer in a heat-sensitive recording layer is excellent in thermal response and sensitivity.

7 Claims, No Drawings

HEAT-SENSITIVE RECORDING MATERIAL

BACKGROUND OF THE INVENTION

This invention relates to a highly sensitive heat-sensitive recording material excellent in thermal response.

A heat-sensitive recording material generally comprises a support and formed thereon a heat-sensitive recording layer composed mainly of an electron donative, colorless or light-colored dye precursor and an electronaccepting color developer. Upon heating with a thermal head, a thermal pen, a laser light or the like, the dye precursor instantaneously reacts with the color developer to give recording images. Such a system is disclosed, for example, in Japanese Patent Examined Publication Nos. 43-4160 and 45-14039. Such heat-sensitive recording materials have been used over a wide range of fields such as measuring recorders, facsimile machines, printers, terminals of computers, labels, automatic ticket vending machines, etc., because the recording can easily be made using a relatively simple device, the maintenance is easy, noises are not produced, and the like. Particularly in facsimile machines, a great demand for heat-sensitive type continues to expand and at the same time, the speed of the machine is getting faster and faster because of necessity for reducing the transmission cost. In response to such a high speed facsimile, the demand for higher sensitive heat-sensitive recording materials is increasing.

In order to transmit and receive a standard original of A-4 size in several to 20 seconds in high speed facsimile machines, it is necessary to repeatedly apply a current to the thermal head in such a very short period of time as several milliseconds or less, and the heat energy generated thereby is transmitted to heat-sensitive recording sheet in which the reaction for forming images is carried out.

In order to carry out the reaction for forming images by the heat energy transmitted in such a short period of time, it is required that the heat-sensitive recording material is excellent in thermal response. To enhance the thermal response or reactivity, compatibility of a color developer with a dye precursor should be improved. For this purpose, sensitizers are used depending on necessity. The sensitizers have an action to accelerate the color-forming reaction by dissolving or enveloping therein dye precursors and color developers present around them when the sensitizers themselves melt with the transferred heat energy. For increasing the sensitivity of the heat-sensitive recording material, it is one method to improve the thermal response of the sensitizers or compatibility of the sensitizers with the dye precursors or color developers.

As such a technique, there are disclosed methods for adding waxe in Japanese Patent Unexamined Publication No. 48-19231; for adding nitrogen-containing compounds, carboxylic acid esters, etc., in Japanese Patent Unexamined Publication Nos. 49-34842, 50-149353, 52-106746, and 53-5636; for adding naphthol derivatives in Japanese Patent Unexamined Publication Nos. 57-64593 and 58-87094; for adding naphthoic acid derivatives in Japanese Patent Unexamined Publication Nos. 57-64592, 57-185187, 57-191089 and 58-110289; and for adding benzoic acid esters in Japanese Patent Unexamined Publication Nos. 57-148688, 57-182483, 58-112788, and 58-162379.

However, the heat-sensitive recording materials produced by these methods are still insufficient in developed colo density and color development sensitivity.

SUMMARY OF THE INVENTION

It is an object of this invention to provide a heat-sensitive recording material excellent in thermal response and sensitivity.

This invention provides a heat-sensitive recording material comprising a support and formed on the support a heat-sensitive recording layer comprising a colorless or light-colored dye precursor, a color developer capable of developing a color of said dye precursor with heating, and a sensitizer, characterized in that said sensitizer is at least one member selected from the group consisting of a compound of the formula:

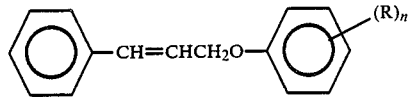

(I)

wherein R is a halogen atom, a lower alkoxy group, or a lower alkyl group; and n is zero or an integer of 1 to 3, and a compound of the formula:

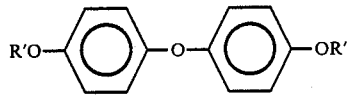

(II)

wherein R' is a lower alkyl group.

DESCRIPTION OF THE PREFERRED EMBODIMENTS

The sensitizer used in this invention is a compound represented by the formula:

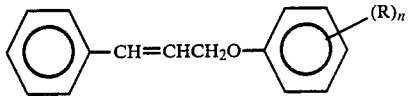

(I)

wherein R is a halogen atom such as chlorine, bromine, iodine or fluorine, a lower alkoxy group preferably having 1 to 4 carbon atoms, or a lower alkyl group preferably having 1 to 4 carbon atoms; and n is zero or an integer of 1 to 3, or a compound represented by the formula:

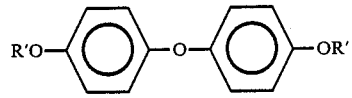

(II)

wherein R' is a lower alkyl group preferably having 1 to 4 carbon atoms, or a mixture thereof.

Preferred examples of the compounds of the formula (I) are as follows:

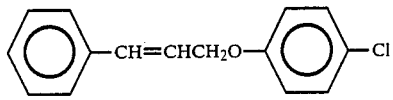

(III)

m.p. = 90.5 to 92° C.

-continued (IV)

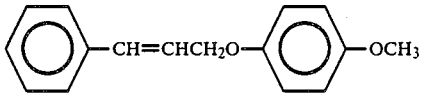

m.p. = 106.5 to 109° C.

(V)

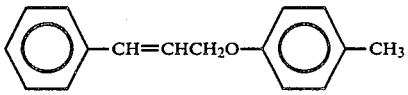

m.p. = 78 to 79° C.

(VI)

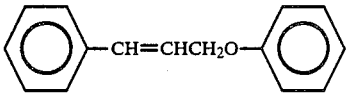

m.p. = 66 to 66.5° C.

(VII)

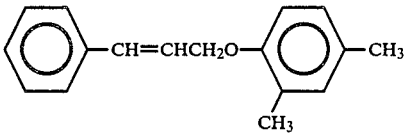

m.p. = 57 to 61.5° C.

(VIII)

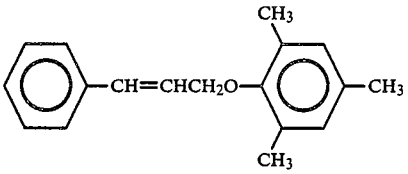

Preferred examples of the compounds of the formula (II) are as follows:

(IX)

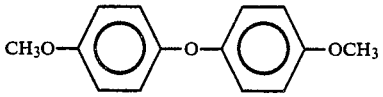

m.p. = 101.0 to 102.5° C.

(X)

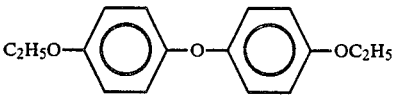

m.p. = 89.5 to 90.5° C.

(XI)

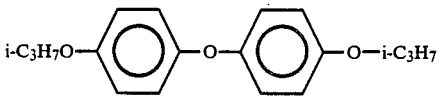

(XII)

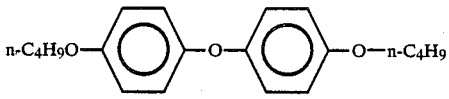

These compounds can be prepared by a conventional process.

The sensitizer is used in an amount of 5% by weight or more, preferably 10 to 400% by weight, more preferably 20 to 300% by weight based on the weight of the color developer. When the amount is less than 5% by weight, the improvement of the sensitivity is insufficient, while when the amount is more than 400% by weight, there sometimes takes place an economical disadvantage.

As the dye precursor, there can be used conventional ones such as triphenylmethanes, fluorans, diphenylmethanes, thiazines, spiropyranes, etc. Examples of the dye precursors are 3,3-bis(p-dimethylaminophenyl)-6-dimethylaminophthalide, 3-(4-diethylamino-2-ethoxyphenyl)-3-(1-ethyl-2-methylindol-3-yl)-4-azaphthalide, 3-diethylamino-6-methyl-7-chlorofluoran, 3-diethylamino-7-chlorofluoran, 3-(N-cyclohexylamino)-7-methylfluoran, 3-diethylamino-7-methylfluoran, 3-diethylamino-6-chloro-7-methylfluoran, 3-diethylamino-7-anilinofluoran, 3-diethylamino-6-methyl-7-dibenzylaminofluoran, 3-(N-ethyl-N-p-toluidino)-7-anilinofluoran, 3-diethylamino-7-(o-chloroanilino)fluoran, 3-dibutylamino-7-(o-chloroanilino)fluoran, 3-diethylamino-6-methyl-7-anilinofluoran, 3-(N-ethyl-N-p-toluidino)-6-methyl-7-anilinofluoran, 3-(N-methyl-N-cyclohexylamino)-6-methyl-7-anilinofluoran, 3-piperidino-6-methyl-7-anilinofluoran, 3-pyrrolidino-6-methyl-7-anilinofluoran, 3-diethylamino-7-(m-trifluoromethylanilino)fluoran, 3-(N-ethyl-N-isopentylamino)-6-methyl-7-anilinofluoran, 3-diethylamino-6-methyl-7-(p-phenetidino)fluoran, 3-dibutylamino-7-(o-fluoroanilino)-fluoran, etc.

As the color developer, there can be used acidic substances conventionally used for heat-sensitive paper, namely, electron-accepting compounds such as phenol derivatives, aromatic carboxylic acid derivatives, N,N'-diarylthiourea derivatives, polyvalent metallic compounds, e.g. zinc compounds, etc.

Preferable examples of the color developers are bisphenols of the formula:

(XIII)

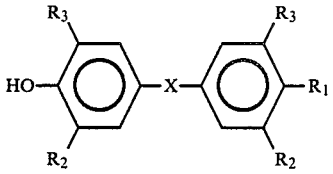

wherein X is

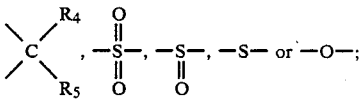

$R_1$ is a hydroxyl group, a lower alkoxy group preferably having 1 to 4 carbon atoms, a lower alkyl group preferably having 1 to 4 carbon atoms, a halogen atom such as chlorine, bromide, iodine or fluorine, or a hydrogen atom; $R_2$ and $R_3$ are independently a hydrogen atom, a lower alkyl group preferably having 1 to 4 carbon atoms, a lower alkenyl group preferably having 1 to 4 carbon atoms or a halogen atom; $R_4$ and $R_5$ are independently a hydrogen atom, a lower alkyl group preferably having 1 to 4 carbon atoms or a lower alkoxycarbonyl group preferably having 2 to 6 carbon atoms, and $R_4$ and $R_5$ may be bonded to form a ring.

Concrete examples of the formula (XIII) are as follows:

2,2-bis(4-hydroxyphenyl)propane,
2,2-bis(4-hydroxyphenyl)butane,
1,1-bis(4-hydroxyphenyl)cyclohexane,
2,2-bis(4-hydroxyphenyl)pentane,
2,2-bis(4-hydroxyphenyl)hexane,
methyl 2,2-bis(4-hydroxyphenyl)acetate, ethyl 2,2-bis(4-hydroxyphenyl)acetate,
butyl 2,2-bis(4-hydroxyphenyl)acetate,
bis(4-hydroxyphenyl)sulfone,
bis(4-hydroxyphenyl)sulfoxide,
4,4'-dihydroxydiphenyl ether,
bis(4-hydroxyphenyl)sulfide,
4-hydroxy-4'-isopropyloxydiphenylsulfone,
4-hydroxy-4'-methyldiphenylsulfone,
4-hydroxy-4'-chlorodiphenylsulfone,
2,2-bis(3-t-butyl-4-hydroxyphenyl)propane,
2,2-bis(3-chloro-4-hydroxyphenyl)propane,
bis(3-allyl-4-hydroxyphenyl)sulfone,
bis(3-t-butyl-4-hydroxy-s-methylphenyl)sulfide,
4-hydroxydiphenylsulfone, etc.

Other preferable examples of the color developers are as follows:

benzyl 4-hydroxybenzoate
1,7-bis(4-hydroxyphenylthio)-3,5-dioxaheptane,
N,N'-bis(3-chlorophenyl)thiourea,
zinc thiocyanate,
N,N'-bis(3-trifluoromethylphenyl)thiourea,
lauryl gallate,
stearyl gallate,
behenyl gallate,
zinc hydroxynaphthoate,
zinc oxide,
salicylic anilide,
dimethyl 4-hydroxyphthalate,
metal(e.g. Zn) salt of 5-t-butyl salicylate,
dimethyl 6-hydroxy-2,3-naphthalenedicarboxylate,
methyl 4-hydroxybenzoate,
4-hydroxybenzoic acid,
benzyl 2,4-dihydroxybenzoate,
benzyl 3,4-dihydroxybenzoate,
4-t-butyl benzoate,
5-chlorosalicylanilide,
isopropyl 4-hydroxybenzoate,
2-phenoxyethyl 4-hydroxybenzoate,
benzoic acid,
novolak-type phenol resin,
2,2'-dihydroxybiphenyl,
1-naphthol,
2-naphthol,
bis(2-hydroxy-5-chlorophenyl)methane,
1,1-bis(2-hydroxy-5-methylphenyl)dodecane,
4-phenylphenol,
4-t-butylphenol,
phenol,

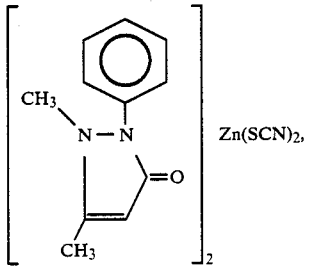

-continued

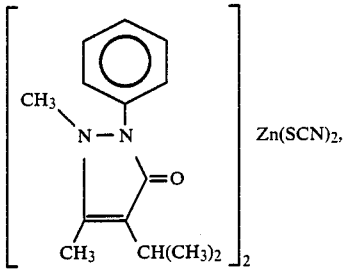

1,5-bis(3-hydroxyphenoxy)pentane,
1,2-bis(3-hydroxyphenoxy)ethane,
1,2-bis(4-hydroxyphenoxy)ethane,
1-(2,4-dihydroxyphenyl)-1-phenylethane,
stearyl 4-hydroxybenzoate,
b 1,1-bis(4-hydroxyphenyl)-1-phenylethane,

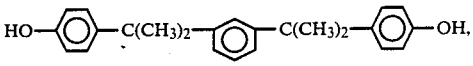

3-(2-phenoxyethoxy)phenol,
p-hydroxyacetophenone,
4,4'-isopropylidenebis(2-t-butylphenol),
4,4'-isopropylidenebis(2-chlorophenol), etc.

The heat-sensitive recording layer may further contain one or more binders, pigments, head wear preventing agents, sticking preventing agents, dispersing agents, ultraviolet absorbers, surface active agents, fluorescent dyes, etc.

Examples of the binders are water-soluble binders such as starches, hydroxyethyl cellulose, methyl cellulose, carboxymethyl cellulose, gelatin, casein, polyvinyl alcohol, modified polyvinyl alcohol, styrenemaleic anhydride copolymers, ethylene-maleic anhydride copolymers, etc.; latex type water-soluble binders such as styrene-butadiene copolymers, acrylonitrile-butadiene copolymers, methyl acrylate-butadiene copolymers, etc.

Examples of the pigments are diatomaceous earth, talc, kaolin, calcined kaolin, calcium carbonate, magnesium carbonate, titanium oxide, zinc oxide, silicon oxide, aluminum hydroxide, urea-formaldehyde resin, etc.

Examples of the head wear preventing agents and the sticking preventing agents are higher fatty acid metal salts such as zinc stearate, calcium stearate, etc.; paraffin, oxidized paraffin, polyethylene, oxidized polyethylene, stearic acid amide, waxes such as castor wax, etc.

Examples of the dispersing agents are sodium dioctylsulfosaccinate, etc.

Examples of the ultraviolet absorbers are benzophenone series compounds, benzotriazole series compounds, etc.

As the support there can be used paper, various kinds of unwoven fabrics, plastic films, synthetic paper, metal foils, composite sheets obtained by combining these materials, etc.

This invention is illustrated in detail by way of the following Examples, in which all percents are by weight unless otherwise specified.

SYNTHESIS EXAMPLE 1

Synthesis of (III)

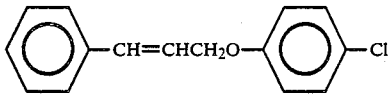

To 100 ml of acetone, 10.1 g of para-chlorophenol, 13.4 g of aqueous solution of 26.1% sodium hydroxide, and 12.2 g of cinnamyl bromide were added and refluxed for 8.5 hours with heating. Then, toluene and water were added to the reaction solution and separated into an organic layer and an aqueous layer. The organic layer was washed with an aqueous sodium hydroxide solution and dried over anhydrous potassium carbonate. After removing the solvent by distillation, the residue was treated with ethanol to yield the desired compound. After recrystallized from ethanol, there was obtained the desired compound having a melting point of 90.5° to 92° C. in an amount of 8.2 g.

SYNTHESIS EXAMPLE 2

Syntnesis of (IV)

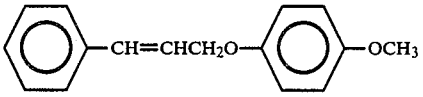

The process of Synthesis Example 1 was repeated except for using 9.7 g of para-methoxyphenol in place of 10.1 g of para-chlorophenol to yield 7.4 g of the desired compound having a melting point of 106.5° to 109° C.

EXAMPLE 1

3-Diethylamino-6-methyl-7-anilinofluoran in an amount of 20 g and 80 g of an aqueous solution of 1% polyvinyl alcohol were ball milled and dispersed. On the other hand, 50 g of 4,4'-isopropylidenediphenol and 200 g of aqueous solution of 1% polyvinyl alcohol were ball milled and dispersed. Further, 50 g of the compound (III) was similarly dispersed in 200 g of aqueous solution of 1% polyvinyl alcohol.

The above-mentioned three kinds of dispersions were mixed and added with 125 g of a 40% dispersion of calcium carbonate, 40 g of a 25% dispersion of zinc stearate, and 285 g of a 10.5% aqueous solution of polyvinyl alcohol, followed by sufficient stirring to give a coating liquid. The coating liquid was coated on base paper having a basis weight of 5.5 g/m$^2$ so as to make the coating amount 6 g/m$^2$ on solid basis, dried and treated with a super calender to give a heat-sensitive recording material.

EXAMPLE 2

The process of Example 1 was repeated except for using 50 g of the compound (IV) in place of 50 g of the compound (III) to give a heat-sensitive recording material.

COMPARATIVE EXAMPLE 1

The process of Example 1 was repeated except for using 50 g of N-hydroxymethylstearic acid amide in place of 50 g of the compound (III) to give a heat-sensitive recording material.

COMPARATIVE EXAMPLE 2

The process of Example 1 was repeated without using the dispersion of the compound (III) to give a heat-sensitive recording material.

[Evaluation]

The heat-sensitive recording materials obtained in Examples 1 and 2 and Comparative Examples 1 and 2 were printed by using a facsimile machine FACOM FAX-621C (a trade name manufactured by Fujitsu, Ltd.). Optical densities of the obtained images were measured by using a Macbeth densitometer RD-514. The results are shown in Table 1.

TABLE 1

| Example No. | Optical density |
|---|---|
| Example 1 | 1.09 |
| Example 2 | 1.08 |
| Comparative Example 1 | 0.97 |
| Comparative Example 2 | 0.55 |

SYNTHESIS EXAMPLE 3

Synthesis of (IX)

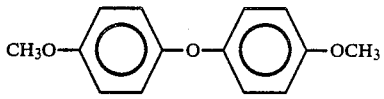

In 50 ml of acetone, 10.1 g of 4,4'-dihydroxydiphenyl ether was dissolved and added with 14.6 g of a 35.6% aqueous solution of sodium hydroxide. To this reaction system, 14.0 g of dimethyl sulfate was added dropwise over 6 minutes with stirring. After continuing the stirring for 5 hours, toluene and water were added to the reaction solution and separated into an organic layer and an aqueous layer. The organic layer was washed with an aqueous solution of sodium hydroxide and dried over anhydrous potassium carbonate. The solvent was removed by distillation. The residue was treated with ethanol to give crystals of the desired compound. The crystals were recrystallized from ethanol to yield 8.9 g of the desired compound having a melting point of 101.0° to 102.5° C.

SYNTHESIS EXAMPLE 4

Synthesis of (X)

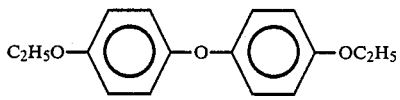

In 50 ml of acetone, 10.1 g of 4,4'-dihydroxydiphenyl ether was dissolved and added with an 34.2% aqueous solution of sodium hydroxide. To this reaction system, 17.4 g of diethyl sulfate was added dropwise with stirring. After refluxing for 6 hours with heating and stirring, the reaction solution was cooled naturally. Then, toluene and water were added to the reaction solution and separated into an organic layer and an aqueous layer. The organic layer was washed with an aqueous solution of sodium hydroxide and dried over anhydrous potassium carbonate. The solvent was removed by distillation. The residue was treated with ethanol to give crystals of the desired compound. The crystals were recrystallized from ethanol to yield 9.9 g of the desired compound having a melting point of 89.5° to 90.5° C.

SYNTHESIS EXAMPLE 5

Synthesis of

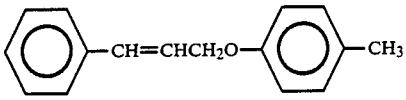

(V)

The process of Synthesis Example 1 was repeated except for using 9.3 g of para-methylphenol in place of 10.1 g of para-chlorophenol to yield 6.0 g of the desired compound having a melting point of 78° to 79° C.

SYNTHESIS EXAMPLE 6

Synthesis of

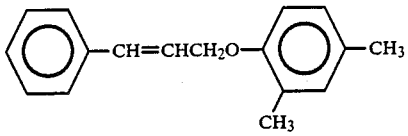

(VII)

The process of Synthesis Example 1 was repeated except for using 10.7 g of 2,4-dimethylphenol in place of 10.1 g of para-chlorophenol to yield 6.0 g of the desired compound having a melting point of 57° to 61.5° C.

EXAMPLE 3

3-(N-Ethyl-N-isopentylamino)-6-methyl-7-anilinofluoran in an amount of 20 g and 80 g of a 1% aqueous solution of polyvinyl alcohol were ball milled and dispersed. On the other hand, 50 g of 2,2-bis(4-hydroxyphenyl)propane and 200 g of a 1% aqueous solution of polyvinyl alcohol were ball miled and dispersed. Further, 50 g of the compound (IX) and 200 g of a 1% aqueous solution of polyvinyl alcohol were ball milled and dispersed.

The above-mentioned three kinds of dispersions were mixed and added with 125 g of a 40% dispersion of calcium carbonate, 40 g of a 25% dispersion of zinc stearate and 300 g of a 10% aqueous solution of polyvinyl alcohol, followed by sufficient stirring to give a coating liquid. The coating liquid was coated on base paper having a basis weight of 49 g/m$^2$ so as to make the coating amount 6 g/m$^2$ on solid basis, dried and treated with a super calender to give a heat-sensitive recording material.

EXAMPLE 4

The process of Example 3 was repeated except for using 50 g of the compound (X) in place of 50 g of the compound (IX) to give a heat-sensitive recording material.

EXAMPLE 5

The process of Example 3 was repeated except for using 50 g of the compound (V) in place of 50 g of the compound (IX) to give a heat-sensitive recording material.

EXAMPLE 6

The process of Example 3 was repeated except for using 50 g of the compound (VII) in place of 50 g of the compound (IX) to give a heat-sensitive recording material.

COMPARATIVE EXAMPLE 3

The process of Example 3 was repeated except for using 50 g of N-hydroxymethylstearic acid amide in place of 50 g of the compound (IX) to give a heat-sensitive recording material.

[Evaluation]

The heat-sensitive recording materials obtained in Examples 3, 4, 5 and 6 and Comparative Example 3 were printed by using a facsimile machine FACOM FAX-621C (a trade name manufactured by Fujitsu, Ltd.). Optical densities of the obtained images were measured by using a Macbeth densitometer RD-514. The results are shown in Table 2

TABLE 2

| Example No. | Optical density |
|---|---|
| Example 3 | 1.29 |
| Example 4 | 1.26 |
| Example 5 | 1.23 |
| Example 6 | 1.23 |
| Comparative Example 3 | 0.90 |

As mentioned above, the heat-sensitive recording materials of this invention are excellent in thermal response and sensitivity.

What is claimed is:

1. In a heat-sensitive recording material comprising a support and formed on the support a heat-sensitive recording layer comprising a colorless or light-colored dye precursor, a color developer capable of developing a color of said dye precursor with heating, and a sensitizer, the improvement wherein said sensitizer is at least one member selected from the group consisting of a compound of the formula:

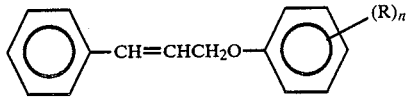

(I)

wherein R is a halogen atom, a lower alkoxy group, or a lower alkyl group; and n is zero or an integer of 1 to 3, and a compound of the formula:

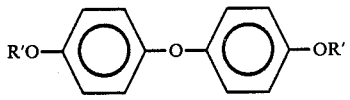

(II)

wherein R' is a lower alkyl group.

2. A heat-sensitive recording material according to claim 1, wherein the sensitizer is used in an amout of 5% by weight or more based on the weight of the color developer.

3. A heat-sensitive recording material according to claim 1, wherein the sensitizer is used in an amount of 10 to 400% by weight based on the weight of the color developer.

4. A heat-sensitive recording material according to claim 1, wherein the sensitizer is a compound of the formula:

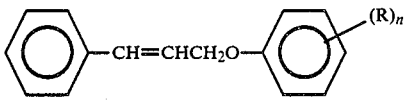

(I)

wherein R is a halogen atom, a lower alkoxy group, or a lower alkyl group; and n is zero or an integer of 1 to 3.

5. A heat-sensitive recording material according to Calim 4, wherein the compound of the formula (I) is

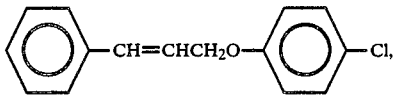

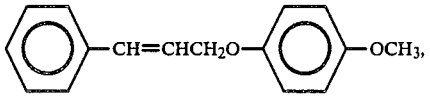

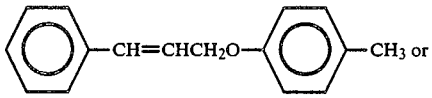

-continued

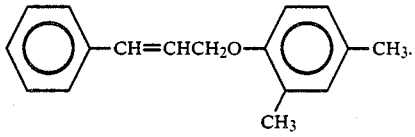

6. A heat-sensitive recording material according to claim 1, wherein the sensitizer is a compound of the formula:

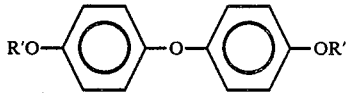

(II)

wherein R' is a lower alkyl group.

7. A heat-sensitive recording material according to claim 6, wherein the compound of the formula (II) is

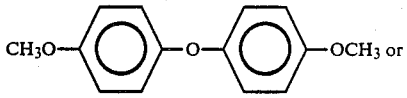

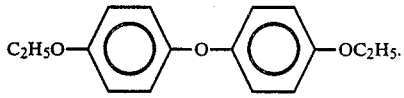

* * * * *